US009115455B2

(12) United States Patent
Polli et al.

(10) Patent No.: US 9,115,455 B2
(45) Date of Patent: Aug. 25, 2015

(54) METHOD AND APPARATUS FOR CONTROLLING THE EXTRACTION DURATION IN A LAUNDRY TREATING APPLIANCE

(75) Inventors: Horacio B. Polli, Joinville (BR); Marcelo C. Silva, Joinville (BR); Luiz H. Stival, Joinville (BR)

(73) Assignee: Whirlpool Corporation, Benton Harbor, MI (US)

( * ) Notice: Subject to any disclaimer, the term of this patent is extended or adjusted under 35 U.S.C. 154(b) by 1161 days.

(21) Appl. No.: 12/964,004

(22) Filed: Dec. 9, 2010

(65) Prior Publication Data

US 2012/0144599 A1 Jun. 14, 2012

(51) Int. Cl.
*D06F 35/00* (2006.01)

(52) U.S. Cl.
CPC ..... *D06F 35/007* (2013.01)

(58) Field of Classification Search
CPC ..... D06F 33/02; D06F 37/304; D06F 35/007; D06F 2204/065; D06F 37/36; D06F 2202/12; D06F 2202/065; D06F 2212/00; D06F 2204/06; D06F 2212/02; D06F 2232/08
USPC ..... 8/159; 68/12.02, 12.14, 12.04, 12.06, 68/12.12, 12.01, 12.16, 23 R, 139
See application file for complete search history.

(56) References Cited

U.S. PATENT DOCUMENTS

| | | | | |
|---|---|---|---|---|
| 4,235,085 | A | 11/1980 | Torita | |
| 4,513,464 | A * | 4/1985 | Rettich et al. | 8/159 |
| 4,765,161 | A | 8/1988 | Williamson | |
| 4,782,544 | A | 11/1988 | Nystuen et al. | |
| 5,181,398 | A | 1/1993 | Tanaka et al. | |
| 5,890,247 | A | 4/1999 | Erickson et al. | |
| 6,609,264 | B2 | 8/2003 | Ruhl et al. | |
| 6,615,619 | B2 | 9/2003 | Kakuda et al. | |
| 7,716,769 | B2 | 5/2010 | Ha et al. | |
| 2005/0102766 | A1 | 5/2005 | Vande Haar et al. | |
| 2005/0204482 | A1 * | 9/2005 | Murray et al. | 8/158 |

FOREIGN PATENT DOCUMENTS

| | | | |
|---|---|---|---|
| CA | 2494429 | A1 | 12/2005 |
| EP | 0302319 | B1 | 12/1991 |
| GB | 1255470 | | 12/1971 |
| GB | 1279057 | | 6/1972 |
| GB | 1528800 | | 10/1978 |
| JP | 6047192 | A | 2/1994 |
| JP | 6126088 | A | 5/1994 |
| JP | 8080396 | A | 3/1996 |
| JP | 2005204968 | A | 8/2005 |
| JP | 2008284405 | A | 11/2008 |

* cited by examiner

*Primary Examiner* — Michael Barr
*Assistant Examiner* — Irina Graf

(57) ABSTRACT

A method and apparatus for monitoring a characteristic of a motor, such as the leveling of torque, for use in determining a duration of an extraction phase of a cycle of operation in a laundry treating appliance.

10 Claims, 4 Drawing Sheets

METHOD AND APPARATUS FOR CONTROLLING THE EXTRACTION DURATION IN A LAUNDRY TREATING APPLIANCE

BACKGROUND OF THE INVENTION

Laundry treating appliances, such as a washing machine in which a drum defines a treating chamber for receiving a laundry load, may implement cycles of operation. The cycles of operation may include different phases during which liquid is applied to the laundry load. The liquid may be removed from the laundry load during an extraction phase where the drum is rotated at speeds high enough to impart a centrifugal force on the load great enough to hold (a/k/a "plaster" or "satellize") the load to the peripheral wall of the drum (the clothes rotate with the drum and do not tumble) and extract liquid from the fabric items. Generally, the faster the rotation speed, the greater the centrifugal force, and the greater the amount of liquid that can be extracted. This process is effective at removing excess liquid from the fabric items to prepare them to be dried.

SUMMARY OF THE INVENTION

A method and apparatus for extracting liquid from the laundry by maintaining a rotation of the treating chamber holding the laundry at a first spin speed until the motor torque is level. When leveling of the motor torque occurs, the extraction phase may be ended or the treating chamber may then be rotated at a second spin speed, which is greater than the first spin speed. This process may be repeated until extraction is completed.

DESCRIPTION OF AN EMBODIMENT OF THE INVENTION

The present invention relates generally to a laundry treating appliance that monitors a characteristic of the motor used to determine the duration of the extraction phase of the cycle of operation. More specifically, the invention is related to controlling the duration of extraction by rotating the treating chamber at a predetermined or set rotational speed until there is leveling of the motor torque.

Figure 1:
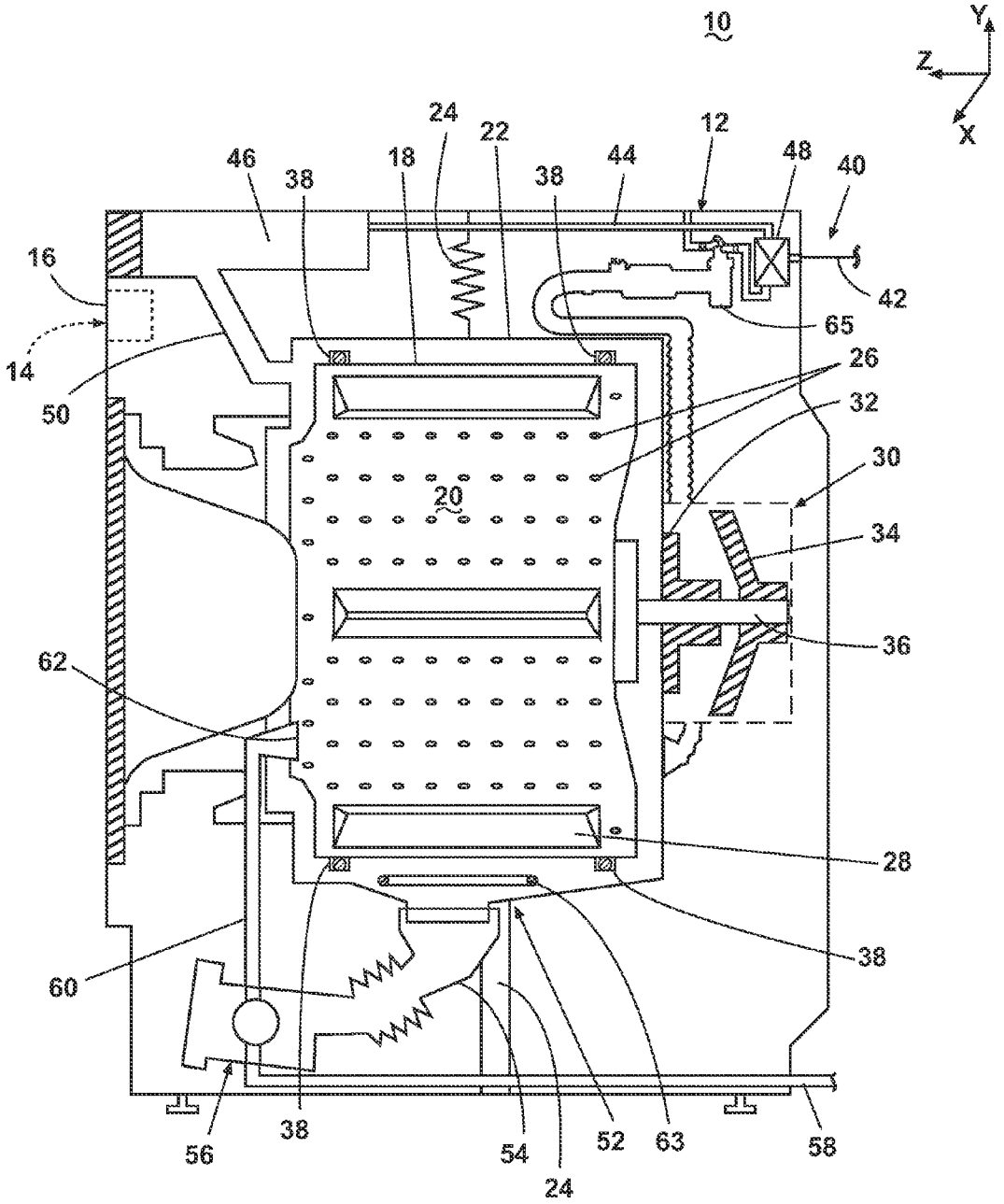
FIG. 1 is a sectional view of a laundry treating appliance according to one embodiment of the invention.

FIG. 1 illustrates one embodiment of a laundry treating appliance in the form of a washing machine 10 according to one embodiment of the invention. The laundry treating appliance may be any machine that treats articles such as clothing or fabrics. Non-limiting examples of the laundry treating appliance may include a horizontal or vertical axis washing machine; a horizontal or vertical axis dryer, such as a tumble dryer or a stationary dryer; a tumbling or stationary refreshing/revitalizing machine; an extractor; a non-aqueous washing apparatus; and a revitalizing machine. The washing machine 10 described herein shares many features of a traditional automatic washing machine, which will not be described in detail except as necessary for a complete understanding of the invention.

While the washing machine 10 is illustrated as a horizontal-axis washing machine, it is within the scope of the invention for the washing machine 10 to be a vertical-axis washing machine. The invention is also applicable to other laundry treating appliances where liquid is extracted by the rotation of the treating chamber. Non-limiting examples of other laundry treating appliances include combination washer/dryers, dryers, and non-aqueous washing machines.

The washing machine 10 may include a cabinet 12 having a controller 14 for controlling the operation of the washing machine 10 to complete a cycle of operation. A user interface 16 on the cabinet 12 may include one or more knobs, switches, displays, and the like for communicating with the user, such as to receive input and provide output.

A rotatable drum 18 may be disposed within the interior of the cabinet 12 and defines a treating chamber 20 for treating laundry. The rotatable drum 18 may be mounted within an imperforate tub 22, which is suspended within the cabinet 12 by a resilient suspension system 24. The drum 18 may include a plurality of perforations 26, such that liquid may flow between the tub 22 and the drum 18 through the perforations 26. The drum 18 may further include a plurality of baffles 28 disposed on an inner surface of the drum 18 to lift the laundry load contained in the laundry treating chamber 20 while the drum 18 rotates. Further, the drum 18 may be coupled with a motor 30 having a stator 32 and a rotor 34 through a drive shaft 36 for selective rotation of the treating chamber 20 during a cycle of operation. It is also within the scope of the invention for the motor 30 to be coupled with the drive shaft 36 through a drive belt for selective rotation of the treating chamber 20.

The motor 30 may rotate the drum 18 at various speeds in opposite rotational directions. In particular, the motor 30 can rotate the drum 18 at speeds to effect various types of laundry load movement inside the drum 18. For example, the laundry load may undergo at least one of tumbling, rolling (also called balling), sliding, satellizing (also called plastering), and combinations thereof. During tumbling, the fabric items in the drum 18 rotate with the drum 18 from a lowest location of the drum 18 towards a highest location of the drum 18, but fall back to the lowest location before reaching the highest location. Typically, the centrifugal force applied by the drum to the fabric items at the tumbling speeds is less than about 1 G. During satellizing, the motor 30 may rotate the drum 18 at rotational speeds wherein the fabric items are held against the inner surface of the drum and rotate with the drum 18 without falling. This is known as the laundry being satellized or plastered against the drum. Typically, the force applied to the fabric items at the satellizing speeds is greater than or about equal to 1 G. For a horizontal axis washing machine 10, the drum 18 may rotate about an axis that is inclined relative to the horizontal, in which case the term "1 G" refers to the vertical component of the centrifugal force vector, and the total magnitude along the centrifugal force vector would therefore be greater than 1 G. The terms tumbling, rolling, sliding and satellizing are terms of art that may be used to describe the motion of some or all of the fabric items forming the laundry load. However, not all of the fabric items forming the laundry load need exhibit the motion for the laundry load to be described accordingly. Further, the rotation of the fabric items with the drum 18 may be facilitated by the baffles 28.

The motor 30 may be any suitable type of motor for rotating the drum 18. In one example, the motor 30 may be a brushless permanent magnet (BPM) motor having a stator 32 and a rotor 34. Other motors, such as an induction motor or a permanent split capacitor (PSC) motor, may also be used. The motor 30 may rotate the drum 18 at various speeds in either rotational direction.

The washing machine 10 may also include at least one balance ring 38 containing a balancing material moveable within the balance ring 38 to counterbalance an imbalance that may be caused by laundry in the treating chamber 20 during rotation of the drum 18. The balancing material may be in the form of metal balls, fluid or a combination thereof. The balance ring 38 may extend circumferentially around a periphery of the drum 18 and may be located at any desired location along an axis of rotation of the drum 18. When multiple balance rings 38 are present, they may be equally spaced along the axis of rotation of the drum 18.

While the illustrated washing machine 10 includes both the tub 22 and the drum 18, with the drum 18 defining the laundry treating chamber 20, it is within the scope of the invention for the washing machine 10 to include only one receptacle, with the receptacle defining the laundry treating chamber for receiving the laundry load to be treated.

The washing machine 10 of FIG. 1 may further include a liquid supply and recirculation system 40. Liquid, such as water, may be supplied to the washing machine 10 from a water supply 42, such as a household water supply. A supply conduit 44 may fluidly couple the water supply 42 to the tub 22 and a treatment dispenser 46. The supply conduit 44 may be provided with an inlet valve 48 for controlling the flow of liquid from the water supply 42 through the supply conduit 44 to either the tub 22 or the treatment dispenser 46.

A liquid conduit 50 may fluidly couple the treatment dispenser 46 with the tub 22. The liquid conduit 50 may couple with the tub 22 at any suitable location on the tub 22 and is shown as being coupled to a front wall of the tub 22 in FIG. 1 for exemplary purposes. The liquid that flows from the treatment dispenser 46 through the liquid conduit 50 to the tub 22 typically enters a space between the tub 22 and the drum 18 and may flow by gravity to a sump 52 formed in part by a lower portion of the tub 22. The sump 52 may also be formed by a sump conduit 54 that may fluidly couple the lower portion of the tub 22 to a pump 56. The pump 56 may direct fluid to a drain conduit 58, which may drain the liquid from the washing machine 10, or to a recirculation conduit 60, which may terminate at a recirculation inlet 62. The recirculation inlet 62 may direct the liquid from the recirculation conduit 60 into the drum 18. The recirculation inlet 62 may introduce the liquid into the drum 18 in any suitable manner, such as by spraying, dripping, or providing a steady flow of the liquid.

A heater, such as sump heater 63 or steam generator 65, may be provided for heating the liquid and/or the laundry.

Additionally, the liquid supply and recirculation system 40 may differ from the configuration shown in FIG. 1, such as by inclusion of other valves, conduits, wash aid dispensers, heaters, sensors, such as water level sensors and temperature sensors, and the like, to control the flow of treating liquid through the washing machine 10 and for the introduction of more than one type of detergent/wash aid. Further, the liquid supply and recirculation system 40 need not include the recirculation portion of the system or may include other types of recirculation systems.

Figure 2:
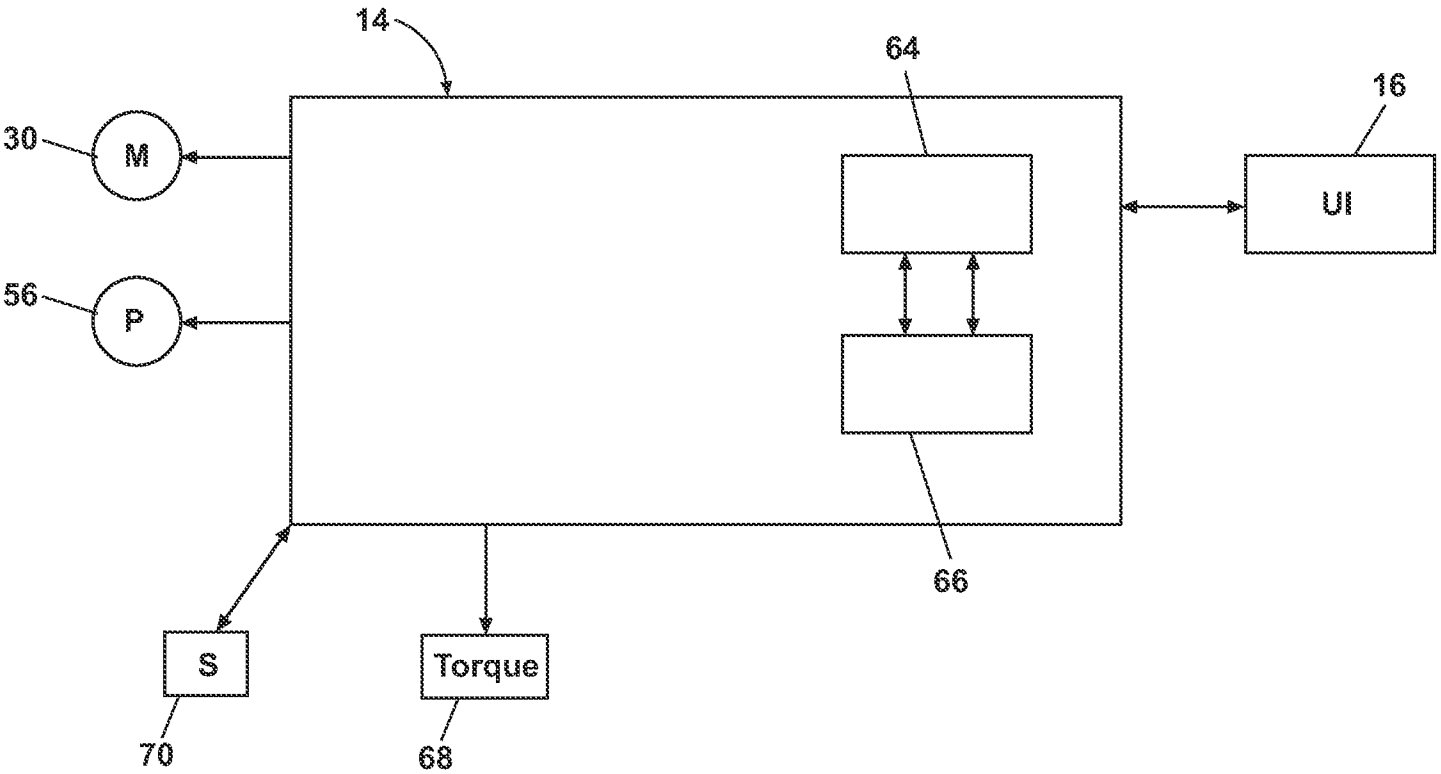
FIG. 2 is a schematic view of a control system of the laundry treating appliance of FIG. 1.

As illustrated in FIG. 2, the controller 14 may be provided with a memory 64 and a central processing unit (CPU) 66. The memory 64 may be used for storing the control software that is executed by the CPU 66 in executing one or more cycles of operation using the washing machine 10 and any additional software. The memory 64 may also be used to store information, such as a database or table, and to store data received from one or more components of the washing machine 10 that may be communicably coupled with the controller 14.

The controller 14 may be operably coupled with one or more components of the washing machine 10 for communicating with and controlling the operation of the component to complete a cycle of operation. For example, the controller 14 may be coupled with the user interface 16 for receiving user selected inputs and communicating information with the user, the motor 30 for controlling the direction and speed of rotation of the drum 18, and the pump 56 for draining and recirculating wash water in the sump 52.

The controller 14 may also receive input from one or more sensors 70, which are known in the art. Non-limiting examples of sensors that may by communicably coupled with the controller 14 include: a treating chamber temperature sensor, a moisture sensor, a weight sensor, a drum position sensor, a motor torque sensor and a motor speed sensor. Additionally, the sensor may be a physical sensor or may be integrated with the motor and combined with the capability of the controller 14, may function as a sensor. For example, motor characteristics, such as speed, current, voltage, torque etc., may be processed such that the data provides information in the same manner as a separate physical sensor. In contemporary motors, the motors often have their own controller that outputs data for such information.

The controller 14 may be operably coupled with the motor 30 of the washing machine 10 for controlling the motor 30 to rotate the drum 18 to complete a cycle of operation. The motor 30 may send motor characteristic information to the controller 14 that is indicative of the applied torque, such as motor current or wattage, as the drum 18 is rotated. The controller 14 may use the motor characteristic information to determine the torque applied by the motor 30 using software that may be stored in the controller memory 64. Alternatively, the controller 14 may receive input from a motor sensor 68 for monitoring the torque and/or speed of the motor 30 applied to the drum 18 during a cycle of operation. The motor sensor 68 may be any suitable sensor, such as an optical sensor or a hall sensor in the case of a speed sensor, or a voltage or current sensor in the case of a torque sensor. The motor sensor 68 may be integrated with the motor, such as with the motor control, or it may be separate from the motor.

The previously described washing machine 10 may be used to implement one or more embodiments of a method of the invention. The embodiments of the method function to control the duration of an extraction phase of the cycle of operation by rotating the treating chamber 20 at a predetermined/set rotational speed until a there is leveling of the motor torque.

Figure 3:
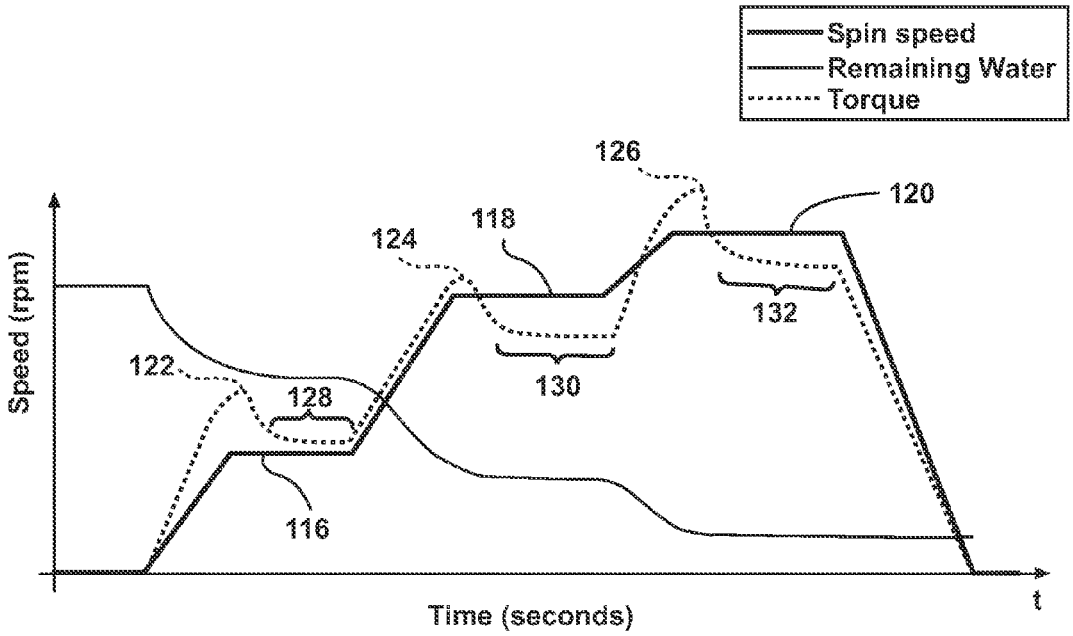
FIG. 3 is a plot of drum speed verses time using the extraction method described in FIG. 3, graphing spin speed, motor torque, and extracted water.

Referring to FIG. 3, prior to describing a method of operation, a brief summary of the underlying phenomena is useful to aid in the overall understanding. FIG. 3 shows the relationship between drum speed during an extraction profile, motor torque, and liquid remaining in the laundry over time. As can be seen, the extraction profile has multiple speed plateaus 116, 118, 120, where the drum 18 is rotated at a set spin speed. As the drum 18 is accelerated to each of these plateaus 116, 118, 120, greater torque is required to accelerate the rotational mass, which is a combination of the mass of the drum 18, laundry, and liquid retained in the laundry. Shortly after reaching the plateau 116, 118, or 120, the torque required to rotate the drum 18 peaks as at 122, 124, 126 and then quickly drops off to an asymptotic phase, where the torque is at a more steady state and trends toward leveling off as at 128, 130, 132. The initial quick drop off of torque is attributable to no longer accelerating the drum 18 in combination with a significant removal of liquid from the laundry during the acceleration, which reduces the mass being rotated. The asymptotic drop off of torque is attributable to the removal of liquid from the laundry load due to the centrifugal force acting on the laundry load while it is being rotated at the set spin speed. As can be seen, the asymptotic leveling of the torque corresponds to a similar asymptotic reduction in the liquid retained in the laundry load. Thus, over time, the rate of liquid removal drops as the drum 18 is rotated at the set spin speed. At some point, it is no longer beneficial to continue rotating at the set spin speed because the amount of removed water is so little, especially from an energy consumption and cycle time perspective.

The invention uses the leveling of the motor torque during a plateau 116, 118, 120 to trigger the completion of the beneficial liquid extraction for a given plateau 116, 118, or 120. The torque applied by the motor 30 may be monitored by the controller 14, and when the leveling of the toque is detected, it may be assumed that there is no more beneficial liquid to be extracted from the laundry at that particular set speed. At this point, the controller 14 can determine if extraction is complete or if more liquid needs to be extracted. If more liquid needs extraction, the drum 18 is accelerated to another, higher, set spin speed and maintained there to form another speed plateau 116, 118, or 120. If extraction is complete, the controller 14 may move on to the next phase, if any, of the cycle of operation.

Figure 4:
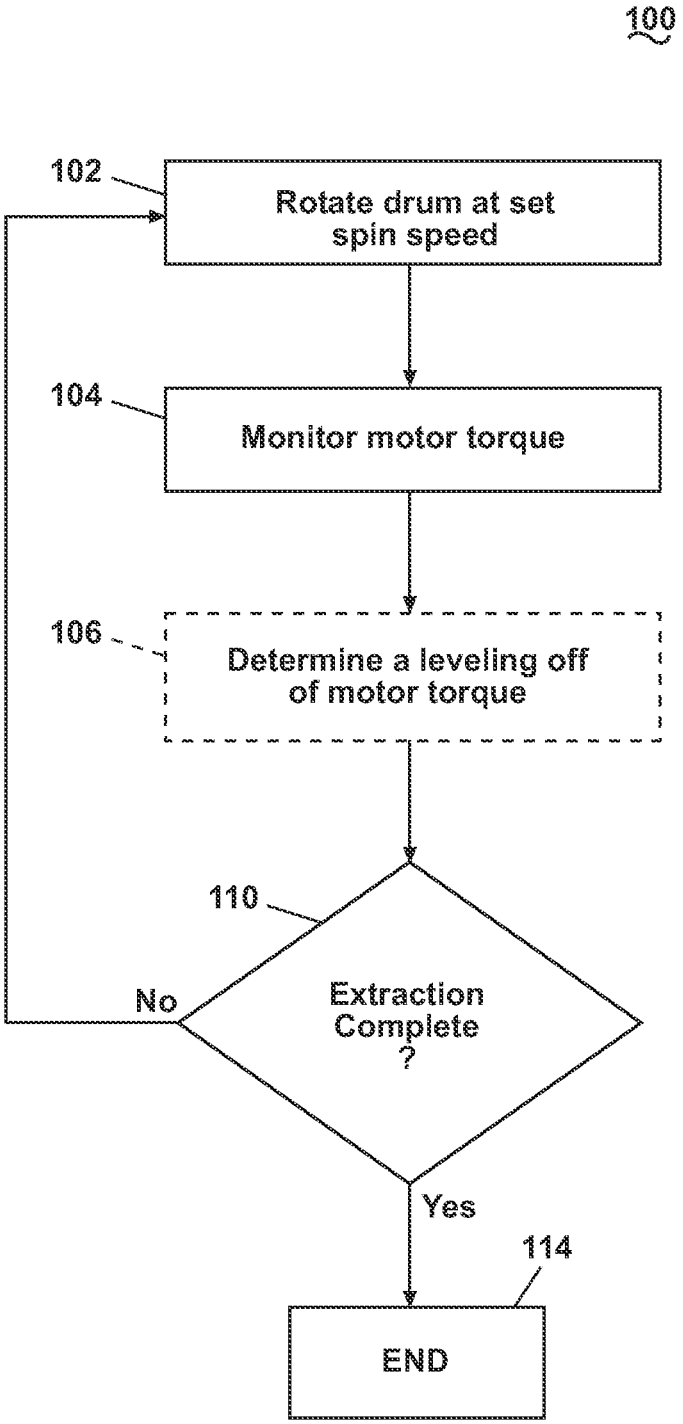
FIG. 4 is a flow chart illustrating an extraction method for controlling the duration of an extraction phase of a cycle of operation according to an embodiment of the invention.

FIG. 4 illustrates a flow chart corresponding to a method of operating the washing machine 10 using an extraction method 100 based on the above described phenomena as implemented during the extraction phase of the cycle of operation according on one embodiment of the invention. The extraction method 100 may be implemented in any suitable manner, such as automatically or manually, as a stand-alone phase or cycle of operation or as a phase of an operation cycle of the washing machine 10. The cycle of operation may include other individual cycles or phases, such as a wash phase and/or a rinse phase, or the cycle of operation may have only the extraction method 100. When the cycle of operation includes other individual phases, the extraction method 100 may function as an intermediate extraction phase, a final extraction phase, or other type of extraction phase. Regardless of the implementation of the extraction method 100, the extraction method 100 may be employed to extract liquid, which may be water, a combination of water and detergent or other wash aid, or other types of fluid, from laundry in the treating chamber 20. The liquid may be imparted to the laundry prior to the extraction method 100 in any suitable manner, such as during a wash phase, a rinse phase, a hand-washing process, or other method for imparting the liquid to the laundry.

The method 100 begins with a first extraction at 102 that comprises rotating the drum 18 at a set spin speed for an initial extraction of liquid from the laundry. The initial extraction removes a portion of the liquid from the laundry. The first spin speed defines a first speed plateau, such as plateau 116 of FIG. 3, and is a rotational speed sufficient to apply at least a 1 G centrifugal force on the laundry.

At 104, while the drum 18 is rotating, the controller 14 may monitor one or more motor characteristic signals, indicative of the motor torque, which as described is a direct output from the motor sensor 68. Other non-limiting examples of characteristics indicative of motor torque include the motor current and motor voltage. As liquid is extracted from the laundry, the mass of the laundry decreases along with a corresponding decrease in the torque required by the motor 30 to maintain the first spin speed of the drum 18.

At 106, a determination is made as to whether the monitored torque has leveled off. This determination may be made in several ways. One of which is determining the time rate of change of the motor torque, which should be a decrease, and comparing it to a threshold. When the time rate of change satisfies the threshold, such as falling below the threshold value. The threshold value for the time rate of change may be selected in light of the characteristics of a given machine. The threshold value may be selected based on balancing liquid removal, energy consumption, and cycle time.

The term "satisfies" the threshold is used here to mean the value compared to the threshold or reference value meets the desired criteria of the comparison because the criteria and threshold values may easily be altered to be satisfied by a positive/negative comparison or a true/false comparison.

Alternatively, it is possible to monitor the magnitude of the torque over time, instead of the time rate of change. For a given load size and type, tabular threshold data may be developed of the torque required to rotate a load of that size and type at a given spin speed. When the magnitude of the torque satisfies the threshold, a leveling may be deemed to occur.

Once a level is determined at 106, control passes to 110 where a determination is made regarding whether the extraction is complete. If the extraction is determined to be complete, the extraction cycle ends and control will pass back to the controller 14 to implement the rest, if any, of the cycle of operation. If extraction is determined not to be complete, the set spin speed is increased and control passes back to 102 and a new spin plateau is implemented and the process is repeated. This process is repeated until the extraction is completed.

Extraction may be completed in a variety of ways. Extraction may be completed when the set spin speed reaches a predetermined upper limit, which may be a function of load size, load type, and load imbalance. Extraction may be completed based on the residual moisture level in the load. Extraction may be completed after the passing of a predetermined amount of time or number of extraction phases completed.

A benefit of the extraction method 110 lies in the ability to more accurately determine when the beneficial liquid extraction has ceased for a given plateau. In prior methods, the plateaus were maintained for a given time period, which was selected to be longer than necessary to ensure that all beneficial liquid had been extracted. With the method of the invention, the plateau times may be reduced, which leads to improved energy consumption and shorter cycle times.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method of operating a laundry treating appliance having a rotating treatment chamber in which laundry is received for treatment and a motor for rotating the treatment chamber, the method comprising:

extracting liquid from laundry by rotating the treatment chamber through multiple, sequentially increasing set spin speeds, which are at least a speed sufficient to satellize laundry in the treatment chamber at each of the set spin speeds, which results in a corresponding constant speed plateau where the treating chamber is rotated at a constant speed for the corresponding set spin speed to define sequentially increasing constant speed plateaus;

ceasing the sequentially increasing speed plateaus when the set spin speed reaches a predetermined upper limit;

monitoring a motor characteristic indicative of motor torque during the speed plateaus;

determining from the monitoring when the time rate of change of the motor torque falls below a predetermined time rate of change threshold value; and sequential advancement from a current one of the speed plateaus to the next one of the speed plateaus is triggered when the time rate of change of the motor torque falls below the predetermined time rate of change threshold value for the current one of the speed plateaus.

2. The method of claim 1 wherein rotating the treatment chamber comprises rotating a drum defining the treatment chamber.

3. The method of claim 1 wherein the determining when the time rate of change of the motor torque falls below the predetermined time rate of chanqe threshold value further comprises determining a leveling of a motor characteristic indicative of motor torque.

4. The method of claim 3 wherein the motor characteristic indicative of the torque is at least one of motor current and motor voltage.

5. The method of claim 2 wherein the determining when the time rate of change of the motor torque falls below the predetermined time rate of chanqe threshold value further comprises determining a leveling of the motor characteristic when a time rate of change of the motor characteristic satisfies a threshold.

6. The method of claim 5 wherein satisfying the threshold comprises a time rate of change being less than the threshold.

7. The method of claim 3 wherein the monitoring detects the leveling of the motor characteristics when a magnitude of the motor characteristics satisfies a threshold.

8. The method of claim 1 further comprising an acceleration phase between each of the speed plateaus.

9. A method of operating a laundry treating appliance having a rotating treatment chamber in which laundry is received for treatment and a motor for rotating the treatment chamber, the method comprising:

extracting liquid from laundry by rotating the treatment chamber through multiple, sequentially increasing set spin speeds, which are at least a speed sufficient to satellize laundry in the treatment chamber at each of the set spin speeds, which results in a corresponding constant speed plateau where the treating chamber is rotated at a constant speed for the corresponding set spin speed to define sequentially increasing constant speed plateaus;

ceasing the sequentially increasing speed plateaus when the residual liquid retained in laundry satisfies a residual liquid threshold;

monitoring a motor characteristic indicative of motor torque during the speed plateaus;

determining from the monitoring when the time rate of change of the motor torque falls below a predetermined time rate of change threshold value; and sequential advancement from a current one of the speed plateaus to the next one of the speed plateaus is triggered when the time rate of change of the motor torque falls below the predetermined time rate of change threshold value for the current one of the speed plateaus.

10. A method of operating a laundry treating appliance having a rotating treatment chamber in which laundry is received for treatment and a motor for rotating the treatment chamber, the method comprising:

extracting liquid from laundry by rotating the treatment chamber through multiple, sequentially increasing set spin speeds, which are at least a speed sufficient to satellize laundry in the treatment chamber at each of the set spin speeds, which results in a corresponding constant speed plateau where the treating chamber is rotated at a constant speed for the corresponding set spin speed to define sequentially increasing constant speed plateaus;

ceasing the sequentially increasing speed plateaus after a predetermined number of advancements;

monitoring a motor characteristic indicative of motor torque during the speed plateaus;

determining from the monitoring when the time rate of change of the motor torque falls below a predetermined time rate of change threshold value; and sequential advancement from a current one of the speed plateaus to the next one of the speed plateaus is triggered when the time rate of change of the motor torque falls below the predetermined time rate of change threshold value for the current one of the speed plateaus.

* * * * *